United States Patent [19]

Kilayko

[11] Patent Number: 4,634,017

[45] Date of Patent: Jan. 6, 1987

[54] RADIATOR FLUSHING DEVICE

[76] Inventor: Greg S. Kilayko, 45 Croman Ct., Hazlet, N.J. 07730

[21] Appl. No.: 808,753

[22] Filed: Dec. 13, 1985

[51] Int. Cl.[4] ..... B65D 51/16

[52] U.S. Cl. ..... 220/203; 220/DIG. 32

[58] Field of Search ..... 220/203, DIG. 32; 137/493.1, 493.6, 322

[56] References Cited

U.S. PATENT DOCUMENTS 2,695,161 11/1954 Lebus .

3,034,521 5/1962 Greenfield ..... 220/DIG. 32

3,349,954 11/1967 May .

3,358,871 12/1967 Leichner .

4,056,120 11/1977 MacNeilage ..... 220/203

*Primary Examiner*—George T. Hall

*Attorney, Agent, or Firm*—Henderson & Sturm

[57] ABSTRACT

A radiator flushing apparatus (10) comprising a modified radiator cap unit (11), a hose coupling unit (12), and a pressure relief unit (13) for establishing a normally fluid tight connection between a pressurized water hose (50) and an automobile radiator (100) for the purpose of flushing contaminants out of the radiator (100).

5 Claims, 4 Drawing Figures

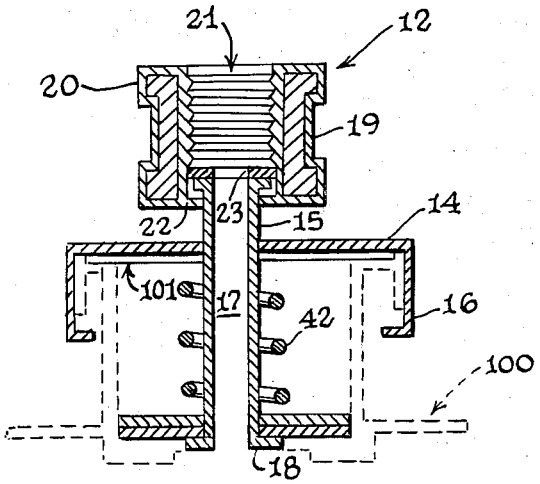
FIG. 2.
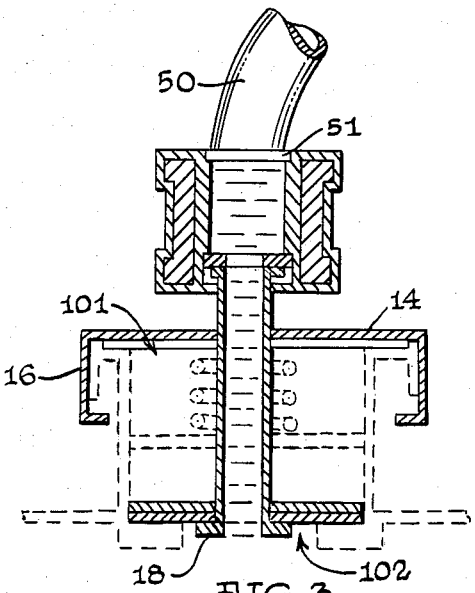
FIG. 3
FIG. 1.
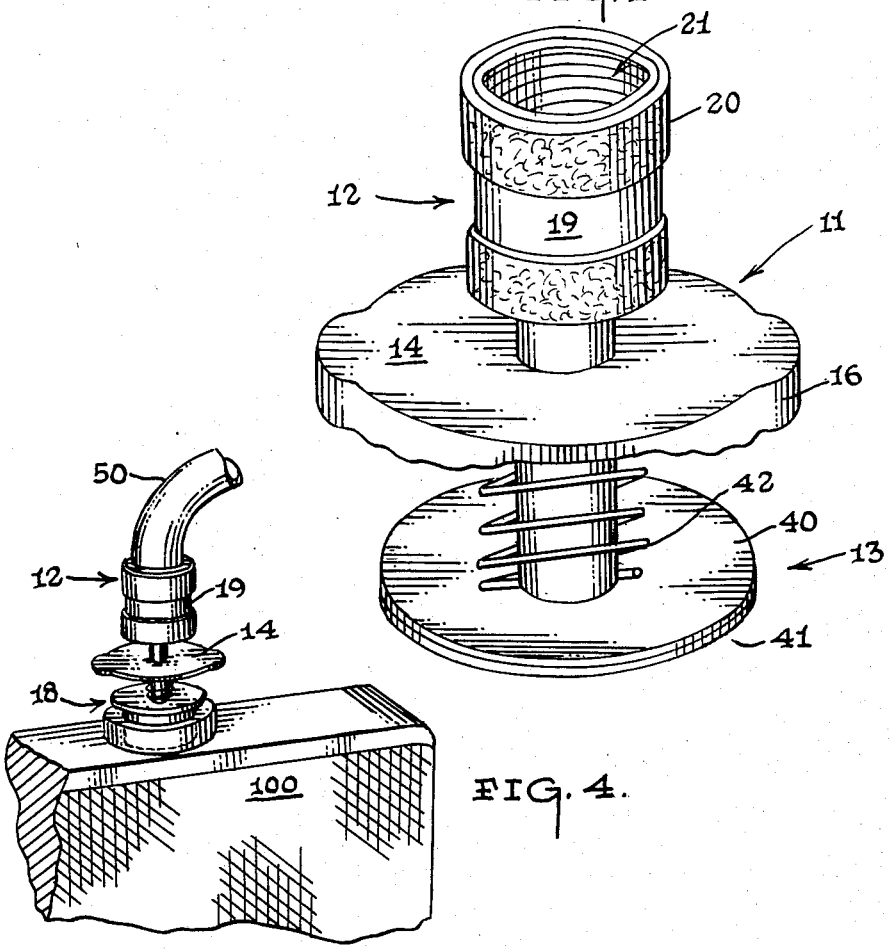
FIG. 4.

RADIATOR FLUSHING DEVICE

TECHNICAL FIELD

The present invention relates generally to apparatus used to facilitate the flushing of automobile cooling systems prior to filling the system with fresh coolant.

BACKGROUND OF THE INVENTION

The present invention comprises the subject matter of Disclosure Document Program Ser. No. 137,615 filed in the U.S. Patent Office on May 15, 1985.

The prior art is replete with diverse methods and apparatus employed to effect the flushing out of an automobile coolant system as may be seen by reference to U.S. Pat. Nos. 2,695,161; 3,349,954; 3,358,871 and 2,558,620.

Unfortunately for the general public, prior art flushing methods require bulky and complex apparatus which are neither economically feasible, nor practical from a limited use and storage standpoint, for an average person to justify owning and keeping around their home or garage.

Realizing that an increasing number of people have assumed the role of "do it yourselfers" regarding routine car maintenance and repair; it became obvious that while the prior art devices were more than adequate for their intended purpose, they did not lend themselves readily to the needs and requirements of this growing segment of the population that realized the economic advantages and personal satisfaction that could be gained from handling routine maintenance procedures on their own.

Once the inherent deficiencies of the prior art methods and apparatus had been recognized, the next step in the development of the present invention was to isolate the most desireable features to be incorporated into an apparatus that would solve these problems. With cost, compactness, ease of use, and, adaptability to a garden variety water hose, being the primary consideration in the development of an improved radiator flushing apparatus, trial and error experimentation was conducted which ultimately resulted in the subject matter that forms the basis of the present invention.

SUMMARY OF THE INVENTION

The improved radiator flushing apparatus of the present invention comprises in general a modified radiator cap unit having a hose coupling unit in open fluid communication through the body of the modified radiator cap unit.

The hose coupling unit is adapted to be engaged in a fluid tight relationship with the outlet of a garden hose connected to a source of pressurized water, for introducing the pressurized water through the body of the modified radiator cap unit.

The modified radiator cap unit in addition to being provided with a tubular element that forms an open fluid passageway; is also provided with a spring biased gasket element, that is operatively associated with the exterior surface of the tubular element, and which functions as a pressure relief valve for the automobile coolant system under certain conditions.

In practice the radiator flushing apparatus of this invention is employed by removing the existing radiator cap from the automobile radiator and replacing it with the subject matter of this invention. When the radiator flushing apparatus is installed, the modified radiator cap unit will securely engage the periphery of the radiator mouth and the edges of the spring biased gasket will be forced into a fluid tight relationship with the radiator inlet port.

At this point, a garden hose connected to a domestic source of pressurized water is engaged in a fluid tight relationship with the hose coupling unit, and the flushing of the automobile coolant system is ready to begin.

The flushing process is initiated by opening the drain at the bottom of the radiator and then introducing pressurized water through the garden hose, while the automobile engine is running and the heater is preferably turned to its maximum setting.

The coolant circulation system in combination with the pressurized water emminating from the garden hose effects a high pressure turbulent flushing of the coolant system; which not only displaces the contaminated coolant; but also dislodges rust and other particulate sediments within the system.

In the event that the combined pressures produced by the automobile coolant system and the domestically pressurized water exceed predetermined values, the resilient gasket element will move out of fluid tight engagement with the radiator inlet to serve as a pressure relief valve.

BRIEF DESCRIPTION OF THE DRAWINGS

These and other objects, advantages and novel features of the invention will become apparent from the detailed description of the best mode for carrying out the preferred embodiment which follows; particularly when considered in conjunction with the accompanying drawings; wherein, FIG. 1 is a perspective view of the radiator flushing apparatus of the present invention;

FIG. 2 is an isolated cross-sectional view of the apparatus;

FIG. 3 is an operative cross-sectional view of the apparatus in use; and,

FIG. 4 is a perspective view of the apparatus connected to a typical automobile radiator.

BEST MODE FOR CARRYING OUT THE INVENTION

As can be seen by reference to the drawings and in particular to FIG. 1, the radiator flushing apparatus that forms the basis of the present invention is designated generally by the reference numeral (10). The radiator flushing apparatus (10) comprises in general a modified radiator cap unit (11), a hose coupling unit (12), and a pressure relief unit (13). These units will now be described in seriation fashion.

The modified radiator cap unit (11) comprises a radiator cap member (14) having a centrally disposed elongated hollow tubular member (15) projecting through the top and bottom of the radiator cap member (14), and disposed in a fluid tight relationship with respect thereto. In addition the radiator cap member (14) is further provided with a depending L-shaped skirt portion (16) that releasably engages the mouth (101) of an automobile radiator (100) in a well recognized fashion.

As can best be seen by reference to FIGS. 2 and 3 the elongated hollow tubular member (15) forms an open fluid passageway (17) through the modified radiator cap unit (11). In addition both the inboard and outboard ends of the elongated hollow tubular member (15) are provided with flange portions (18) that form the operative connections between the modified radiator cap unit (11), the hose coupling unit (12), and the pressure relief unit (13).

The hose coupling unit (12) comprises a female hose coupling member (19) rotatably secured to the outboard end of the elongated hollow tubular member (15). The female hose coupling member (19) is further provided with at least one enlarged external friction surface (20), a threaded bore (21) having a reduced diameter shoulder portion (22), and a resilient washer element (23).

As can best be seen by reference to FIG. 3 the hose coupling unit (12) is provided to establish open fluid communication between a hose member (50) connected to a source of domestically pressurized water (not shown) and the interior of the automobile radiator, as will be explained shortly.

Again referring to FIG. 3, it can be seen that the threaded bore (21) of the female hose coupling member (19) is dimensioned to be threadedly engaged by a commplementary male coupling member (51) and female (19) coupling members to form a fluid tight seal therebetween.

The pressure relief unit (13) is best described in FIGS. 2 and 3 and comprises a generally flat rigid washer element (40) provided on its lower face. The rigid washer element (40) and the resilient sealing gasket (41) are slidingly disposed on the exterior surface of the elongated tubular member (15) and normally biased downwardly against the inboard flange portion (18) of the tubular member (15) by means of a helical spring element (42) that surrounds the hollow tubular member (15).

As shown in the drawings, the resilient sealing gasket (41) is normally engaged with the inboard flange (18) of the tubular member (15) when the apparatus (10) is not operatively connected to an automobile radiator (100). When the apparatus (10) is operatively engaged with an automobile radiator (100), the resilient gasket (41) is brought into fluid tight sealing engagement with the periphery of the radiator inlet (102), whereby under normal operating conditions the apparatus (10) provides a generally liquid tight fluid connection between the hose member (50) and the radiator (100).

In the event that the fluid pressure within the radiator (100) exceeds acceptable levels, the resilient sealing gasket (41) will move away from the periphery of the radiator inlet (102) to relieve the pressure within the automobile coolant system (not shown) in a well recognized manner.

Having thereby described the subject matter of this invention, it should be obvious that many substitutions, modifications, variations, and reversal of parts are possible in light of the above teachings. It is therefore to be understood that the invention as taught and described herein, is only to be limited to the extent of the breadth and scope of the appended claims.

I claim:

1. A radiator flushing apparatus in combinatin with a hose connected to a source of pressurized water and an automobile radiator, wherein the apparatus comprises:

a modified radiator cap unit having an elongated hollow tubular member forming an elongated open fluid passageway through the modified radiator cap unit;

a hose coupling unit secured on one end of the elongated tubular member, and adapted to engage said hose in a fluid tight relationship; and, a pressure relief unit secured to the other end of the elongated tubular member and having a resilient sealing gasket adapted to sealingly engage the periphery of the inlet of said automobile radiator, whereby the pressurized water from said hose may be in open fluid communication with the interior of the said automobile radiator.

2. The apparatus of claim 1; wherein, the modified radiator cap unit comprises a radiator cap member having a depending skirt portion that releasably engages the mouth of said automobile radiator.

3. The apparatus of claim 2; wherein the elongated hollow tubular member is provided with flange portion on its inboard and outboard ends, and projects through said radiator cap member in a fluid tight relationship.

4. The apparatus of claim 3; wherein, the pressure relief unit comprises a rigid washer element secured to said resilient sealing gasket wherein said rigid washer element and said resilient sealing gasket are slidingly disposed on said elongated hollow tubular member.

5. The apparatus of claim 4; wherein, the pressure relief unit further comprises a helical spring element that biases said resilient sealing gasket and said rigid washer element against the inboard flange portion of said elongated hollow tubular member.

* * * * *